United States Patent [19]

Penick et al.

[11] 4,349,973

[45] Sep. 21, 1982

[54] POP-UPS AND METHODS OF MAKING

[75] Inventors: Ib Penick, Prospect Heights; John K. Volkert, Northfield, both of Ill.

[73] Assignee: Compak Systems, Inc., Northfield, Ill.

[21] Appl. No.: 133,493

[22] Filed: Mar. 21, 1980

Related U.S. Application Data

[60] Continuation-in-part of Ser. No. 934,202, Aug. 16, 1978, Pat. No. 4,212,231, which is a division of Ser. No. 746,340, Dec. 1, 1976, Pat. No. 4,146,983.

[51] Int. Cl.[3] ..... G09F 1/00

[52] U.S. Cl. ..... 40/124.1; 46/34

[58] Field of Search ..... 40/158, 124.1, 539; 46/34, 35, 36

[56] References Cited

U.S. PATENT DOCUMENTS

| | | | |
|---|---|---|---|
| 2,742,723 | 4/1956 | Klein et al. | 40/124.1 |
| 2,935,238 | 5/1960 | Koehler | 40/124.1 |
| 2,974,434 | 3/1961 | Gibson | 40/124.1 |
| 3,721,029 | 3/1973 | Austin | 40/124.1 |
| 4,146,983 | 4/1979 | Penick | 40/124.1 |

FOREIGN PATENT DOCUMENTS

| | | | |
|---|---|---|---|
| 758823 | 10/1956 | United Kingdom | 40/124.1 |

*Primary Examiner*—Gene Mancene
*Assistant Examiner*—Wenceslao J. Contreras
*Attorney, Agent, or Firm*—Fitch, Even, Tabin, Flannery & Welsh

[57] ABSTRACT

Improved promotional pop-up designs capable of fabrication by mechanical mass production, particularly as a part of a web-press operation. A pair of pop-up elements in the form of two panels which are attached to one another, preferably by adhesive, are interconnected by hinges to basepieces that constitute the halves of a folder. Automatic web-press operation can die-cut hinge elements, either within the basepieces or within the pop-up elements in the moving web. Both pop-up elements may be formed from the sheet material located adjacent one edge of a basepiece, or the pop-up elements may be formed in flanking relation to the basepieces with one pop-up element along each lateral edge of the moving web, or they may alternate across the web.

27 Claims, 12 Drawing Figures

DIE CUT
A
GLUE
B
FOLD & TRIM
C
GLUE HINGES
D
FOLD & TRIM
E
FOLD
F
FOLD & SEVER
G

DIE-CUT A
GLUE HINGE B
FOLD C
GLUE D
FOLD, TRIM & SEVER E
FOLD, TRIM & SEVER F
ALIGN E
GLUE & SEVER D
FOLD C
GLUE B
DIE-CUT A

POP-UPS AND METHODS OF MAKING

RELATED APPLICATIONS

This application is a continuation-in-part of our earlier-filed application Ser. No. 934,202, filed Aug. 16, 1978, now U.S. Pat. No. 3,212,231, which was a division of our earlier patent application Ser. No. 746,340, filed Dec. 1, 1976, now U.S. Pat. No. 4,146,983, issued Apr. 3, 1979.

BACKGROUND OF THE INVENTION

This invention relates to printed paper novelty devices of various types, and more particularly to dimensional and specialty paper products of this general character wherein a "pop-up" is provided. It is especially directed to the creation of a promotional piece wherein a pop-up is created between the facing pages of a folder that, upon opening of the folder, moves upward and out of the plane of the remainder of the folder panels and more particularly to methods for the economical mass production of such items. Our earlier U.S. Pat. No. 3,995,388, issued Dec. 7, 1976, discloses methods for making pop-up paper products having significant advantages over the hand-assembly methods generally theretofore employed for the production of such products. Our U.S. Pat. No. 4,146,983, referred to above, discloses methods for making other novel promotional items, particularly those designed to present a plurality of coupons to the recipient upon opening of the folder. Development work has continued with respect to adapting such pop-up items to economical mass production, particularly as a part of a web-press operation—especially items including a pop-up of the type formed from two separate sheet material panels.

SUMMARY OF THE INVENTION

The present invention provides improved designs for promotional pop-ups of this general character which are capable of fabrication by mechanical mass production, particularly as a part of a web-press operation. The improved design utilizes a pair of pop-up elements in the form of two panels which are attached to one another, preferably by adhesive, and which are interconnected by hinges to the two basepieces that constitute the halves of the folder. The designs facilitate automatic web-press operation wherein hinge elements are appropriately formed in the web, as by die-cutting, either within the basepieces or within the pop-up elements, which fabrication can be carried out upon the moving web. Both pop-up elements may be formed from the sheet material located adjacent one edge of a basepiece, or the pop-up elements may be formed in flanking relation to the basepieces with one pop-up element along each lateral edge of the moving web.

DETAILED DESCRIPTION OF THE PREFERRED EMBODIMENTS

Figures 1, 2, 3:
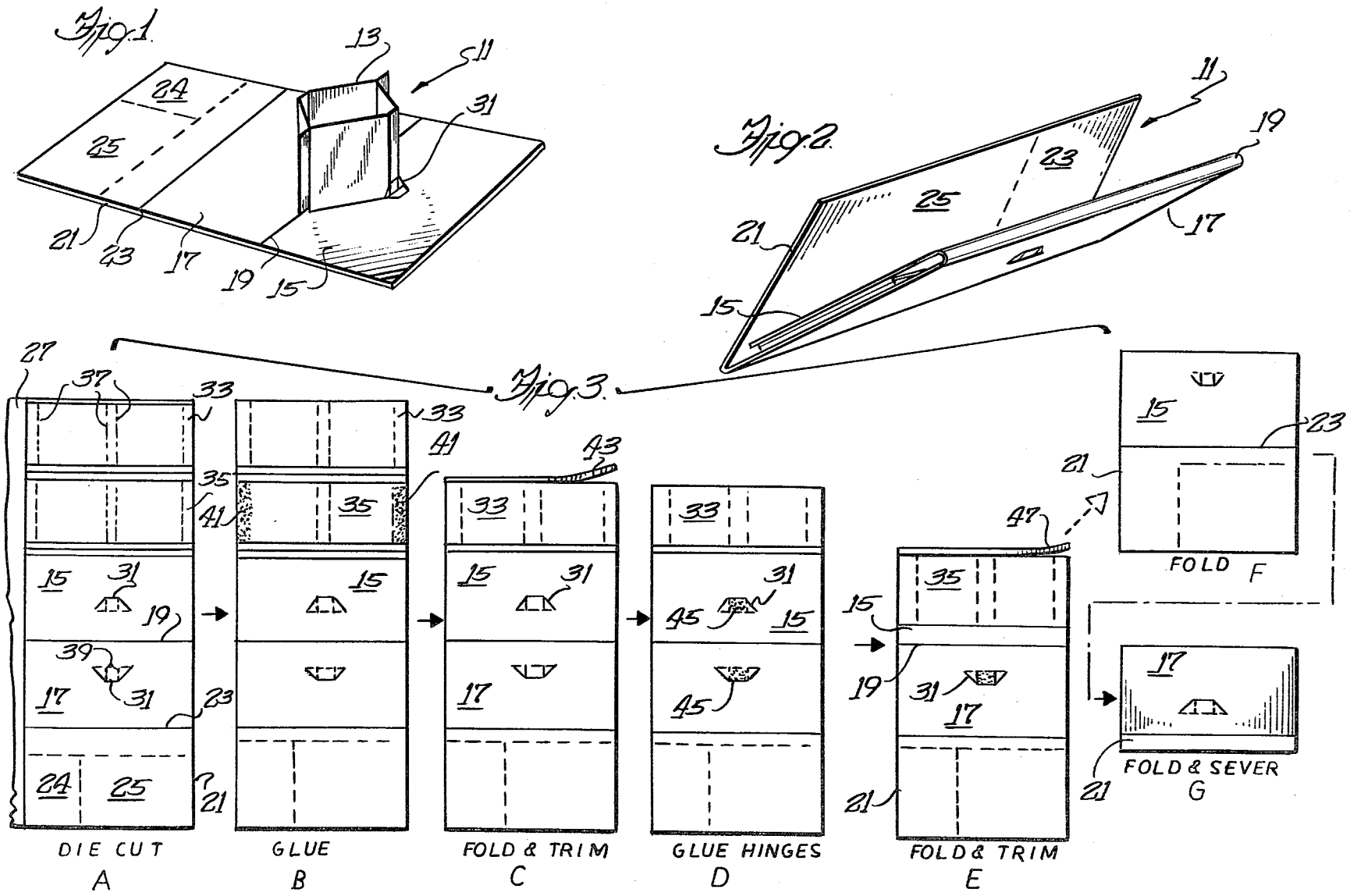
FIG. 1 is a perspective view showing a promotional item embodying various features of the invention.
FIG. 2 is a perspective view showing the item of FIG. 1 in folded condition.
FIG. 3 is a schematic view illustrating one manner in which the items illustrated in FIGS. 1 and 2 might be produced as a part of a web-press operation.

FIG. 1 shows a promotional item or piece 11 in the form of a three-panel folder having a pop-up assembly 13 attached thereto which rises up out of the plane of the sheet material upon opening the folder. The two panels 15, 17 to which the pop-up assembly 13 is attached are referred to as base panels or basepieces and in this particular embodiment are joined along a common hinge line 19. The third panel 21 is hinged along the opposite lateral edge 23 of the second base panel 17 and may include a coupon 24 and/or a business reply card 25 or even a return envelope.

Although the term "folder" is generally used herethroughout, for purpose of convenience, to describe the ultimate items which function by the unfolding or opening of the hinged basepieces to which the pop-up structure is attached, use of the term does not imply that a folding operation is absolutely necessary in the method of fabrication, although such is preferred. Reference is made in this respect, to U.S. Pat. No. 3,995,388 which indicates that the basepieces may be formed from the same sheet by folding that sheet upon itself or by joining separate basepieces adhesively or otherwise along one edge to form a hinged or false backbone construction.

FIG. 3 is a diagrammatic representation of an automatic method for making items 11 having the construction depicted in FIGS. 1 and 2, starting with a continuous web 27 of sheet material. In the depicted fabrication method, the web 27 should be understood as being moved in a left-to-right direction. Individual stations in the web-press operation are labeled as A through G, and for convenience of illustration, the web is shown as being segmented so as to illustrate an individual blank in each station upon which a particular operation is being carried out. However, in the usual web press operation, all of the die-cutting, folding and adhesive application operations would commonly be carried out in web form, and the web 27 itself would not be cut transversely into individual blanks or items until reaching the final shape as shown in the far right-hand Station G.

At Station A, the web 27 is die-cut, press-scored and perforated. A pair of first and second hinge elements 31 are cut in the region of the web which forms the first and second base panels 15,17, which hinge elements are located equidistantly from the line of demarcation 19 along which the base panels are hinged. This line 19 may be press-scored or may simply be left to be formed at the time of the ultimate folding operation which takes place between Stations E and F.

Two pop-up elements 33,35 are located in the region bordering the first base panel 15. Lines parallel to the line 19 are shown, for purpose of illustration, to define the pop-up elements 33,35 although these lines would normally not appear in the web 27 itself. However, to define the shape of the pop-up structure, a plurality of transverse lines of weakness 37 are provided in the two pop-up elements 33,35, and these lines are preferably produced at this stage as press-scores. Two lines of perforations which meet at right angles are provided in the bottom portion of the web 27, as viewed in FIG. 3, and these lines define the business reply card 25 and the coupon 24. The line of demarcation 23 between the second base panel and the third panel 21, may be formed by a press-score, if desired, or can be created during the final folding step between Stations F and G.

As best seen in FIG. 3, the hinge elements 31 are generally trapezoidal in shape with the three shorter sides being completely die-cut and with the base of the trapezoid being a press-score. Preferably, a pair of parallel lines of weakness 39 are also provided which are in general alignment with the central press-scores 37 in the pop-up elements 33,35 and which define a pair of generally square hinge tabs located centrally of each of the trapezoidal hinge elements 31. The hinge elements 31 of course remain attached to the remainder of the basepieces 15,17 along the edge of the base of the trapezoid.

At Station B, an adhesive pattern 41 is applied to the leading and trailing edges of one of the pop-up elements and for purposes of illustration, the adhesive patterns 41 are applied to what is referred to as the second pop-up element 35. In actuality, inasmuch as the web 27 will be continuous at this stage, adhesive application will be effected simultaneously to the trailing edge of one blank and the leading edge of the following blank of the moving web.

Between Stations B and C, a folding operation is effected wherein the top edge portion of the web, which constitutes the region of the first pop-up element 33, is folded 180° onto the top of the region of the second pop-up element 35. At this point, joinder of the two pop-up elements at the leading and trailing edges by means of the previously applied adhesive pattern is effected to create the two-panel pop-up structure 13. Any suitable adhesive can be used, such as a hot-melt adhesive or a solvent-based adhesive. Furthermore, it is also possible that a heat-activated or an ultrasonic-activated adhesive could be applied at an earlier time (even before die-cutting) by printing onto the continuous web 27, and then the adhesive bond may be achieved by subjecting the folded assembly to heat or ultrasonic energy, as appropriate at the leading and trailing regions. Likewise, such adhesives could be employed at the regions of the individual hinge elements 31 although, for purpose of simplicity, reference is hereinafter only made to the application of adhesive in general. Likewise, some other method of joinder, for example, stapling, could be used; however, the use of adhesive is definitely preferred.

At Station C, the upper edge 43 of the moving, folded web is trimmed to remove the line along which the first and second pop-up elements 33,35 were hinged together. Following the trimming operation, the first and second pop-up elements 33,35 are interconnected only at the leading and trailing edges by the adhesive bond.

At Station D, an adhesive pattern 45 is applied to the hinge elements 31 in the central regions of the square tabs. As the web 27 then moves between Stations D and E, a folding operation occurs whereby the pop-up structure 13 is folded 180° so as to place the first pop-up element 33 in surface contact with the first basepiece 15 so that an adhesive connection is effected between the first hinge element 15 and the central portion of the first pop-up element.

At Station E, a second trimming operation is effected wherein what is now the top edge portion 47 of the web 27 is removed to eliminate the original connection between the upper edge of the first basepiece 15 and the second pop-up element 15. As the web 27 approaches Station F, a further folding operation occurs whereby the first basepiece 15 is folded onto the second basepiece 17 along the line 19 to produce the structure depicted in Station F. The superimposition of the first basepiece 15 on the second basepiece 17 sandwiches the pop-up structure 13 therebetween and effects the adhesive bond between the second hinge element 31 and the second pop-up element 35.

The final folding operation takes place between Stations F and G whereby the completed folder 11 with the pop-up structure 13 sandwiched between the first and second basepieces is folded onto the third panel 21 to arrive at the configuration depicted in Station G of FIG. 3. Following Station G, the continuous web 27 would then be severed transversely to cut it into individual units 11 having the configuration as shown in FIG. 2.

The inclusion of the third panel 21 might be employed to secure the item in a saddle-bound magazine or the like. In such a case, one or more staples might be inserted through the sheet material at the fold line 23 so as to attach the item to the center of the magazine. In such an instance, the printed matter carried on the third panel would normally relate to the same promotion as the subject matter of the pop-up structure 13. If the item 11 were inserted elsewhere into the magazine, the third panel 21 might be directed to some other promotion.

FIG. 2 depicts the item 11 as it might be viewed by a recipient opening the magazine to the center section. After it has been folded out fairly flat, unfolding of the first basepiece 15 relative to the second basepiece 17 causes the pop-up structure 13 to arise out of the plane of the sheet material. FIG. 1 depicts the item after the first basepiece 15 has been unfolded a full 180° so that the pop-up structure 13 stands upright, being held in this position by the connection between the hinge tabs 31, which are integral with the basepiece, and the opposite central regions of the pop-elements 33,35.

Figures 4, 5, 6, 7:
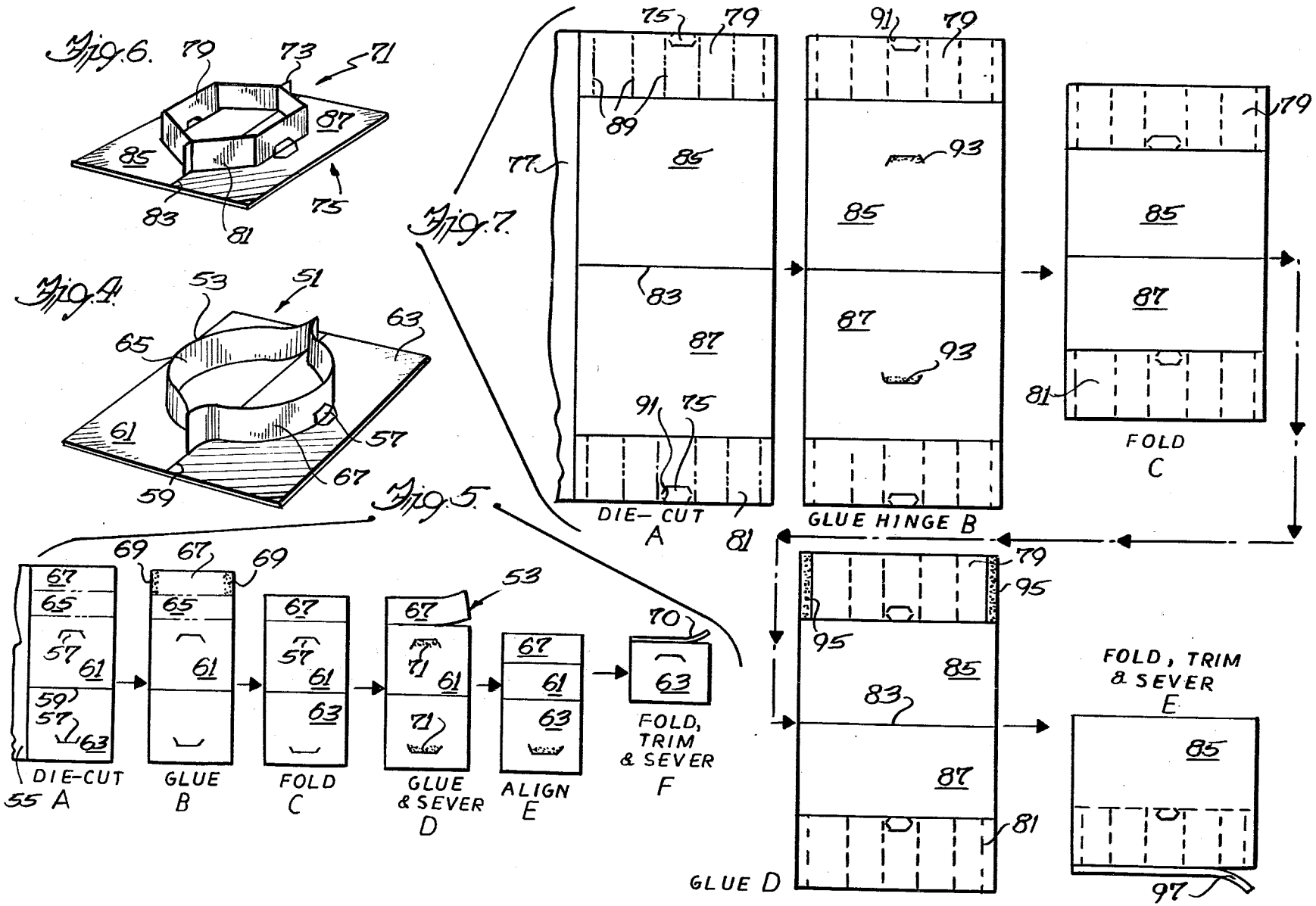
FIG. 4 is a perspective view of an alternative embodiment of an item incorporating various features of the invention.
FIG. 5 is a schematic view similar to FIG. 3 of a production-line arrangement for fabricating the item shown in FIG. 4.
FIG. 6 is a perspective view of still another embodiment of an item incorporating various features of the invention.
FIG. 7 is a schematic view similar to FIG. 3 of a production-line arrangement for fabricating the item illustrated in FIG. 6.

Depicted in FIG. 4 is a slightly modified item 51 which includes a two-panel folder to which a generally similar pop-up structure 53 is attached. Transverse fold lines in the pop-up structure 53 are omitted so as to give a circular appearance thereto.

Depicted in FIG. 5 is a diagrammatic view of a forming and fabrication process illustrated as a part of a web-press operation wherein the web 55 would be continuously moving from left to right. Again, although the individual blanks are shown at Stations A through F, it should be understood that the web 55 would usually not be severed transversely until following the folding and trimming operation that is depicted at Station F.

At Station A, a die-cutting operation is effected to create first and second hinge elements 57 which are spaced equidistantly from what would be the centerline 59 of the folder which includes a first basepiece 61 and a second basepiece 63. Although this centerline 59 is shown for purposes of illustration and, as earlier indicated, it might be provided in the form of a press-score, it more likely might simply be omitted at this point—relying upon the ultimate folding operation between Stations E and F to create the actual line. Pop-up elements 65 and 67 are ultimately formed from the region of the sheet material web 55 located above the first basepiece 61, and llines of demarcation defining these pop-up elements 65,67 would not usually be created at Station A, instead being later created by the first folding operation.

At Station B, an adhesive pattern 69 is applied to the leading and trailing edges of the second pop-up element 67, and the statements previously indicated with respect to the FIG. 3 fabrication process apply equally hereto. As the continuous web 55 moves to Station C, the second pop-up element 67 is folded onto the first pop-up element 65, and interconnection is made at the leading and trailing edges by the adhesive patterns 69.

At Station D, an adhesive pattern 71 is applied to the hinge elements 57, and the pop-up structure 53 is severed from the edge of the first basepiece 61 by suitable knife means to create a continuous ribbon. The continuous ribbon is gradually moved into alignment above the upper edge of the first basepiece 61 and is then lowered onto it so that the first pop-up element 65 contacts it and an adhesive bond is created centrally thereof with the first hinge element 57. This realignment of the ribboned pop-up structure 53 is depicted in Station E.

A final folding operation then takes place between Stations E and F when the second basepiece 63 is folded about the centerline 59 and into superimposed position upon the first basepiece 61. In this orientation, the pop-up structure 53 is sandwiched between the folded basepieces 61,63, and the adhesive pattern 71 on the hinge element 57 of the second basepiece effects a bond between it and the central section of the second pop-up element 67. Trimming of an upper edge portion 70 from the folded web is effected at Station F, and thereafter the continuous web is cut transversely into the separate items 51.

When the recipient opens the folder formed by the two basepieces, the adhesive connections at the hinge elements 57 pull the two panels 65,67 of the pop-up structure 53 apart, creating the upstanding generally circular structure illustrated in FIG. 4. This serves as a very effective attention-getting device, and it would normally carry a printed picture and perhaps copy which is of course complementary to the message which appears on the basepieces 61,63.

Shown in FIG. 6 is yet another modification of an item 71 which includes a pop-up structure 73 which, in its completed form, is generally similar to that shown in FIG. 4 except for the fact that hinge elements 75 are provided as a part of the pop-up structure 73 and adhesively attached to the basepieces.

FIG. 7 depicts a method for fabricating the item 71 illustrated in FIG. 6 as a part of a web-press operation wherein the web 77 is first appropriately printed and then fashioned into the pop-up-containing folder. At Station A, the regions of the web which will constitute two pop-up elements 79,81 are die-cut to provide the hinge elements 75. These hinge elements 75 are located centrally of the individual blank (with respect to the longitudinal direction of movement of the web) and are adjacent the upper and lower lateral edges thereof. They are also equidistant from the centerline 83 of the blank, which ultimately constitutes the hinge line of the folder and which may or may not be created at this time, as by a press score. Likewise, the lines of demarcation between basepieces 85,87 and the pop-up elements 79,81 will usually not be created at this time. The illustrated embodiment shows parallel press-score lines 89 in the regions of the two pop-up elements 79, 81 which give a distinctive polygonal shape to the ultimate pop-up structure 73, plus a pair of generally converging lines 91 along which the hinge elements 75 are connected to the remainder of the pop-up elements.

At Station B, an adhesive pattern 93 is applied to the basepieces 85,87 at locations which correspond to the positions of the hinge element 75. Folding of both edge portions of the advancing continuous web 77 takes place as indicated between Station B and Station C. As a result, the adhesive patterns 93 connect the hinge elements 75 to the first basepiece 85 and the second basepiece 87.

At Station D, an adhesive pattern 95 is applied to the leading and trailing edge regions of the first pop-up element 79 which is now of course disposed in superimposed relationship upon the first basepiece 85. As earlier indicated with regard to fabrication of the other devices, the adhesive pattern 95 at the leading edge portion of one blank would be applied simultaneously with the pattern at the adjacent trailing edge of the preceding blank of the continuous web 77.

As the web 77 advances from Station D to Station E, the final folding operation is effected about the centerline 83 so that the first basepiece 85 becomes superimposed atop the second basepiece 87. As a result, the two pop-up elements 79,81 are aligned with each other, and the adhesive patterns 95 along the leading and trailing edges effect their joinder to create the two-panel pop-up structure 73. A final trimming of the lower edge portion 97 of the web 77 is effected at Station E, which removes the original interconnections between the lateral edges of the basepieces 85, 87 and the respective flanking pop-up elements 79,81.

Following the subsequent transverse cutting of the continuous web 77 into the individual items 71, the fabrication is complete. Opening of the two-panel folder by the recipient is illustrated in FIG. 6 wherein it can be seen that the adhesive attachment between the hinge elements 75 in the pop-up structure 73 to the interior surfaces of the basepieces 85,89 causes the pop-up to stand up substantially perpendicular to the plane of the fully opened folder and provide the desired polygonal configuration.

Figures 8, 9, 10:
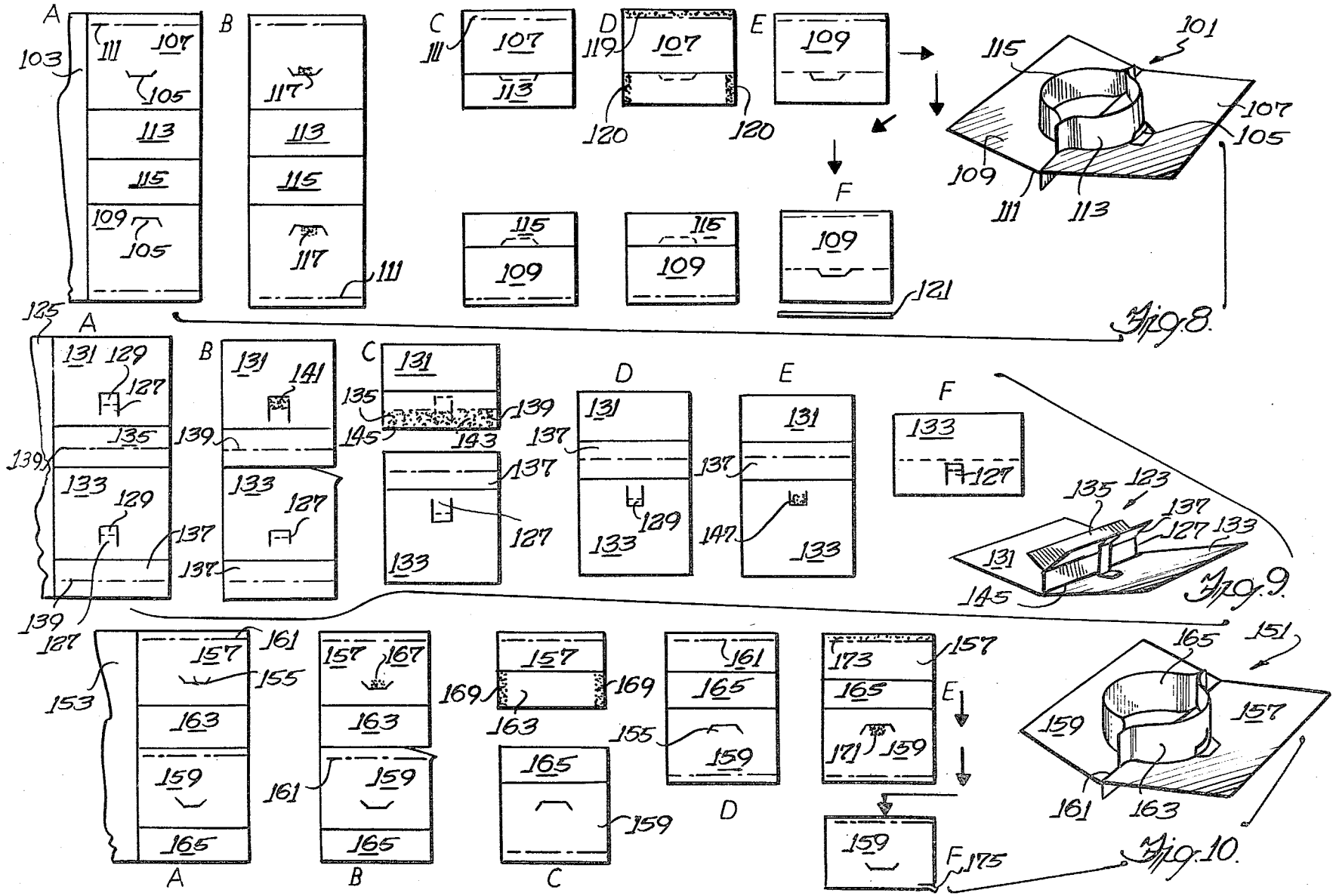
FIGS. 8 to 12 are schematic views generally similar to FIG. 3 of further alternative methods for fabricating items of this type.

FIG. 8 depicts yet another method for fabricating a pop-up structure 101 which, in its completed form, is quite similar to the item 51 depicted in FIG. 4, with the exception that the basepieces are interconnected along a generally common line by means of providing a false backbone instead of utilizing a hinge line formed between adjacent panels in the original sheet material web. FIG. 8 depicts a web-press operation wherein the web 103 is first appropriately printed and ultimately fashioned into the pop-up containing folder 101 as it travels through a series of stations. At station A, a die-cutting operation is carried out to create hinge elements 105 in the regions of the sheet which will constitute the first basepiece 107 and the second basepiece 109. Although lines of demarcation are shown in the web to define the basepieces and the pop-up elements for purposes of description, it should be understood that these lines need not actually exist as they will be subsequently created by means of cutting and/or folding operations. Optional press scorelines 111 are shown in the web adjacent the outer edges beyond which the false backbone is formed and these press scores define the straight, substantially common line about which the pivotal relationship of the basepieces in the finished product 101 is established. Located between the basepieces 107 and 109 is a central panel which constitutes the regions that become pop-up elements 113,115.

At Station B, an adhesive pattern 117 is applied to the central regions of the hinge elements 105, and as the web travels from Station B to Station C, it is severed down the center of the central panel to separate the pop-up elements 113, 115 from each other and leave each of them hinged to its respective basepiece. At Station C, the pop-up element 113 is folded onto the basepiece 107 and adhesive connection is effected between the hinge element 105 and the pop-up element surface by means of the adhesive pattern 117. A similar folding of the pop-up element 115 onto the basepiece 109 and its attachment to the hinge element occurs.

At Station D, an adhesive pattern 119 is applied to the region of the first basepiece 107 lying between the edge and the scoreline 111, and an adhesive pattern 120 is also applied to the leading and trailing edges of the pop-up element 113. As earlier indicated, the first basepiece 107 and the pop-up element 113 combination will still be a part of a continuous web, and accordingly the adhesive patterns 120 will be applied at the same time to the panels 113 following and trailing in the web.

Between Station D and Station E, the web containing the basepiece 109 and the pop-up element 115 is turned over 180° and aligned with and superimposed atop the web to which the adhesive patterns 119 and 120 have been applied. As a result, the basepiece 109 is joined to the basepiece 107 along the upper edges by the glue pattern 119 along the score line 111, and the pop-up elements 113,115 are joined to each other by the adhesive patterns 120. At the final Station F, the lower edge is trimmed from the superimposed webs, and the webs are severed transversely to create the individual items. Trimming of the edge 121 removes the original hinged interconnection between the pop-up elements 113,115 and the respective basepieces 107,109, leaving the pop-up elements connected to each other by the adhesive patterns 120 and attached to the respective basepieces by the hinge elements 105. When the folder is opened, the basepieces 107,109 pivot relative to each other along the substantially common line of the score lines 111 being held together in the false backbone created by the adhesive pattern 119. The attachments between the hinge elements 105 and the pop-up elements 113,115 cause the pop-up structure to assume the three-dimensional orientation illustrated.

Illustrated in FIG. 9 is a generally similar forming and fabrication process which is part of a web-press operation that creates a pop-up structure 123 which has a slightly different form than the structure 101. Again, a web 125 is appropriately printed and then fashioned into the pop-up containing folder 123 as it is moved from left to right in the drawing. At Station A, the printed web is die-cut and press scored to form elongated hinge elements 127 which may optionally contain a score line to define end tabs 129 in regions of the web which will ultimately form basepieces 131,133. Pop-up elements 135,137 are located in the web adjacent the lower edge of the respective basepieces. Press score lines 139 are preferably located down the center of each of the pop-elements, which scores are parallel to the edges of the web.

At Station B, an adhesive pattern 141 is applied to the end tab 129 of the hinge element 127 in the basepiece 131. Between Station B and Station C, the web is severed centrally at the line of demarcation between the pop-up element 135 and the basepiece 133, and the pop-up element 135 is folded onto the basepiece 131. Adhesive attachment therebetween occurs between the adhesive pattern 141 on the hinge element and the upper portion of the pop-up element 135 lying above the score line 139. At Station C, a glue pattern 143 is applied to the lower portion of the pop-up element 135 in the region between the score line 139 and the bottom edge 145 about which it is hinged to the basepiece 131.

Between Stations B and C, the lower web is turned over by rotating 180°, so the pop-up element 137 lies closest to the other web. Between Stations C and D, the web is displaced laterally so that the pop-up element 137 is aligned with and superimposed upon the pop-up element 135 at Station D, to which it becomes attached by the adhesive pattern 143.

At Station E, a final adhesive pattern 147 is applied to the end tab 129 of the hinge element 127. At Station F, the basepiece 133 is folded onto the remainder of the web in superimposed position upon the basepiece 131 effecting adhesive attachment between the hinge element 127 and the pop-up element 137 by means of the adhesive pattern 147. This completes the fabrication of the item, and severing of the web into the individual items is carried out at this point.

When the recipient opens the folder formed by the two basepieces 131,133, adhesive connections at the hinge elements 127 pull the upper halves of the pop-up panels 135,137 lying above the score lines 139 outward from the central stem formed by the adhesive attachment of the two pop-up members together in this region as a result of the adhesive pattern 143. The basepieces pivot relatively to each other about the substantially common hinge line 145, giving the pleasing appearance depicted in the final view.

FIG. 10 illustrates a fabrication method generally similar to that just described with respect to FIG. 9 for the production of a pop-up structure 151 resembling the structure 101 described hereinbefore. The fabrication method is also described with regard to a web-press operation wherein a web 153, which has been first appropriately printed, travels to Station A where a pair of hinge elements 155 are die-cut into the regions of the web which will constitute the basepieces 157,159. The web is also preferably provided with a pair of press scores 161 for defining edge regions of the basepieces that are employed to create a false backbone. Regions of the web which will constitute the pop-up elements 163,165 need not be demarcated at this time but are situated respectively adjacent the lower edge of each basepiece as in the FIG. 9 embodiment.

At Station B, a glue pattern 167 is applied to the central region of the hinge element 155 in the basepiece 157, and the web is cut down its center into two continuous webs at the location between the pop-up elements 163 and the basepiece 159. At Station C, the pop-up element 163 is folded onto the basepiece 157 wherein its adhesive attachment to the hinge element is made by the adhesive pattern 167. Thereafter, a glue pattern 169 is applied to the leading and trailing edges of the pop-up element 163 in the manner as previously described with respect to the glue pattern in FIG. 8.

As it travels to Station C, the lower web is turned over 180° so that the pop-up element 165 lies closest to the other web. At Station D, the web is displaced so that the pop-up element 165 is aligned with the pop-up element 163 and in superimposed registration therewith. Attachment between the two pop-up elements occurs at this point by the adhesive patterns 169. At Station E, an adhesive pattern 171 is applied to the central portion of the hinge element 155 in the basepiece 159, and an adhesive pattern 173 is applied along the upper edge in the region above the score line 161.

As the web moves to Station F, it is folded to bring the basepiece 159 into superimposed relationship atop the basepiece 157, and pressure may be applied to assure a firm adhesive attachment occurs at the pattern 171 between the hinge element 155 and the pop-up element 165 and between the two basepieces at the pattern 173. Following folding, a thin strip 175 is trimmed from the bottom edge to remove the original interconnections between the pop-up elements 163,165 and their respective basepieces where the folding occurred. Fabrication of the items is now complete, and the composite web is severed transversely to produce the individual units.

When the recipient opens the folded item 151, its appearance is essentially the same as the item 101 illustrated in FIG. 8. The foregoing thus illustrates how the general fabrication method depicted in FIG. 9 can be modified to produce a pop-up structure essentially the same as the item 101, and it should be understood that the fabrication method depicted in FIG. 8 can be similarly modified in a manner to produce a pop-up structure essentially the same as the item 123 illustrated in FIG. 9.

Figures 11, 12:
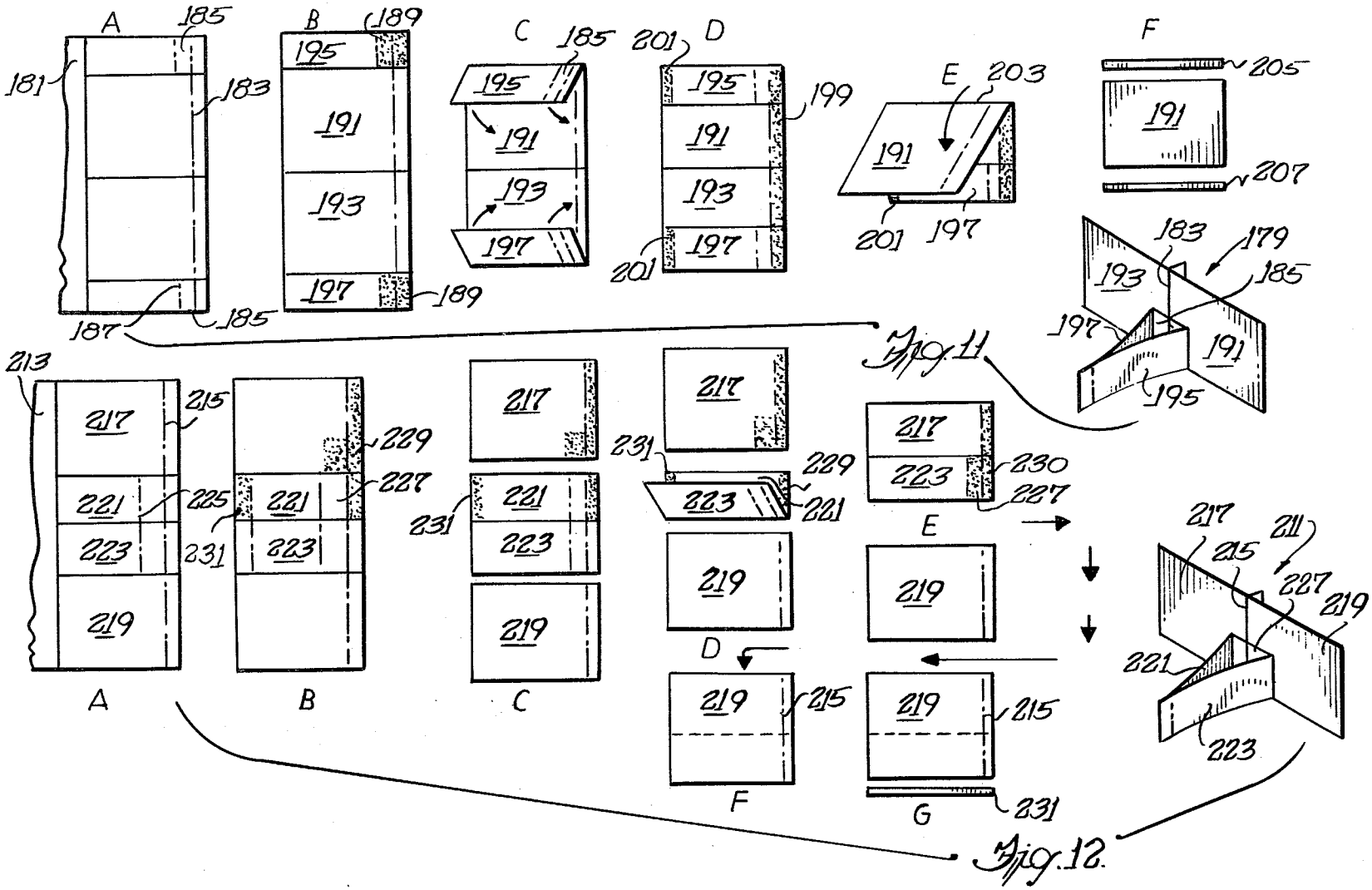

Illustrated in FIG. 11 is a modification of the fabrication method shown in FIG. 7 to produce a pop-up structure 179 of a slightly different character. A web 181 is preferably scored along its leading edge with a line 183 that defines an edge region which will ultimately serve as a false backbone for the folder. A pair of hinge elements 185 are preferably also demarcated by score lines 187. At Station B, an adhesive pattern 189 is applied to the hinge elements 185 and to the adjacent section of the leading edge of the web region. Although longitudinal lines of demarcation would not normally be formed in the web, they are shown in FIG. 11 facilitate the description. The center portion of the web constitutes basepieces 191,193 and is flanked by the regions which constitute the pop-up elements 195,197.

At Station C, the pop-up elements 195,197 are folded onto the underlying basepieces 191,193, and the hinge elements 185 become adhesively attached to the upper surface of the basepieces by the adhesive pattern 189. At Station D, an adhesive pattern 199 is applied along the entire leading portion of the web, and adhesive patterns 201 are applied at the trailing edge portions of the pop-up elements 195,197. If desired, the adhesive patterns can be limited to half the web, e.g. the panels 191 and 195. Alternatively, the adhesive pattern 189 that was applied at Station B can be extended to cover the entire leading portion of the web, in which case the pattern 199 would be limited to the leading edge of one or both of the pop-up elements.

At Station E, the web is folded along a line 203 to superimpose the basepiece 191 atop the basepiece 193. Pressure can be applied if desired to assure that there is firm adhesive attachment along the false backbone in the region of the adhesive pattern 199 and between the pop-up elements 195,197 in the region of the adhesive pattern 201. At Station F, the upper and lower longitudinally traveling edges are trimmed by removing thin strips 205 and 207. The removal of the thin strip 205 eliminates the original interconnection at the hinge line 203 between the basepieces, and the removal of the thin strip 207 eliminates the original interconnections between the pop-up elements and their respective basepieces. This completes the fabrication of the items 179, and the web is transversely severed into individual units.

When the recipient opens the basepieces 191,193 from their folded orientation, the pivoting of the sheets relative to each other carries along the hinge elements 185 of the pop-up element and causes the pop-up structure to assume a three-dimensional tower-like orientation, as depicted in the final view.

Illustrated in FIG. 12 is an alternative fabrication method for producing a pop-up item 211 which is essentially the same as the item 179 just described. A continuous web 213 can be impressed with a press score at Station A to provide a score line 215, which extends just behind the leading edge of each section of the web that will constitute a single item, to demarcate a leading edge section that will serve as a false backbone. The web 213 is printed so that the outermost panels will constitute basepieces 217,219, and a central panel will be folded in half and ultimately form pop-up elements 221,223. A score line 225 is preferably impressed in the central panel region to define hinge elements 227.

At Station B, an adhesive pattern 229 is applied which covers the upper one-half of the leading edge strip forward of the score line 215 and also a rectangular region occupying substantially a region equal to that of the hinge element 227. An adhesive pattern 231 is also applied at the trailing edge region of the pop-up element 221.

At Station C, the web is cut or severed into three continuous strips constituting the two basepieces and the central panel, which forms the two pop-up elements 221,223. At Station D, the central web strip is folded so as to superimpose the pop-up element 223 atop the pop-up element 211 with the leading and trailing edges becoming adhesively attached to each other by the adhesive patterns 229,231.

At Station E, the folded central web is superimposed atop the basepiece 217 and aligned along the lower edge thereof so that the hinge element 227 of the pop-up element 221 becomes attached to the basepiece 217 by the adhesive pattern 229. An adhesive patterns 230 is applied to the pop-up element 223 at Station E. Between Stations E and F, the web which constitutes the basepiece 219 superimposed atop the basepiece 217 so that the hinge element 227 of the pop-up element 223 becomes attached to the basepiece 219 by the adhesive pattern 230 at the same time as the adhesive joinder of the entire leading edge of the web in the region of the false backbone is effected.

At Station G, the lower edge is trimmed to remove a strip 231 which constitutes the folded edge connection between the pop-up elements 221,223 and the adjacent edge regions of the basepieces to present a neat-appearing edge for the ultimate item. The trimming completes the fabrication, and the web is then severed transversely to produce the individual items. As shown in the final view of FIG. 12, the item 211 is essentially the same in appearance to the item 179. Although the item is depicted in the open position with the pop-up structure occupying a lower region, this is done for consistency of reference to the remaining views of the FIGURE, and in reality, it may be desirable to position the attention-attracting pop-up structure at the top of the printed folder 211.

Although the invention has been described with regard to certain preferred embodiments which constitute the best modes presently known to the inventors, various modifications and changes as would be obvious to one having the ordinary skill in this art may be made to the illustrated structures and/or methods without deviating from the scope of the invention which is defined in the appended claims. For example, although the illustrated examples show the inclusion of a pair of hinge elements either in the basepieces or in the pop-up elements, one hinge element could be provided in a basepiece and the other hinge provided in the appropriate pop-up element. Likewise, the hinge elements need not be positioned equidistantly from a central line of reference, even in respect to those fabrication methods where the web is laid out in such a balanced relationship, because the pop-up elements need not both have the same height. An irregular line might be die-cut in one of the panels initially that ultimately results in an irregular edge following a final trimming operation along perpendicular edges. As earlier mentioned, although it is convenient to utilize the natural hinge which is created by folding one basepiece atop another as the backbone or hinge-line of the ultimate folder, if one wishes to accommodate a particular fabrication process, this initial line of joinder could be severed in any of the illustrated methods, and an adhesive pattern could be provided along an edge of one basepiece which, upon subsequent superimposition of the two basepieces, creates a new line of joinder in the form of a false backbone, as illustrated with respect to FIGS. 8,10,11 and 12. The ultimate line of joinder could be one which is parallel to the direction of movement of the continuous web or which is transverse to the direction. Of course, in the latter instance, the orientation of the hinge elements might also be rotated 90° in the plane of the sheet material so that they remain generally parallel to the common line along which the basepieces are hinged, as is illustrated in FIGS. 11 and 12 with respect to the pop-up structures of a slightly different character.

With respect to the methods illustrated, various of the steps can be performed in different sequences while accomplishing the same end result. Although the web-press operations illustrated are considered to be advantageous, the methods can also be performed on folding machines. Although adhesive joinder is preferred as the most practical approach and, as such, is described in the specification and in the claims, it should be recognized that known equivalent methods of attachment, e.g., stapling, crimping, interlocking, may alternatively be used without departing from the invention.

Various of the features of the invention are emphasized in the claims which follow.

What is claimed is:

1. A method of making an item of the character described, which method comprises providing sheet material which is proportioned to create a folder in the form of facing first and second basepieces adapted to pivot relative to each other along a substantially common line between open and closed positions and to create a pair of pop-up elements, all of which are originally interconnected in said sheet material, forming a pair of hinge elements in said sheet material, associating at least one of said pop-up elements with a first surface of said first basepiece positioned adjacent a peripheral edge thereof and effecting adhesive attachment between said pop-up element and said first basepiece at one of said hinge elements, following said association and said adhesive attachment, simultaneously severing said sheet material along said peripheral edge of said first basepiece and along a peripheral edge of said associated pop-up element to free said pop-up element from an original interconnection, adhesively attaching said pair of pop-up elements to each other, superimposing said basepieces with said first surface of said first basepiece facing inward toward said second basepiece, and adhesively attaching the other of said pop-up elements to said second basepiece at the other of said hinge elements.

2. A method in accordance with claim 1 wherein said first and second basepieces are joined originally in said sheet material along said common line which is parallel to a line along which a pop-up element is hinged to said first basepiece.

3. A method in accordance with claim 1 wherein said hinge elements are formed in said basepieces.

4. A method in accordance with claim 1 wherein said hinge elements are formed in said pop-up elements.

5. A method in accordance with claim 2 wherein said hinge elements are formed at locations substantially equidistant from said common line.

6. A method in accordance with claim 1 wherein both of said pop-up elements are formed from one sheet material panel which is interconnected to said edge of said first basepiece.

7. A method in accordance with claim 6 wherein said one panel is severed from said first basepiece prior to effecting said adhesive attachment between said pop-up element and said first basepiece.

8. A method in accordance with claim 7 wherein said severing step removes the folded edge of said one panel along which said pop-up elements are interconnected and is carried out following said superimposing.

9. A method in accordance with claim 8 wherein said basepieces are substantially rectangular in shape, wherein trimming is carried out along the edge opposite to that along which said severing occurs and wherein said basepieces are joined together along a third edge prior to said trimming.

10. A method in accordance with claim 6 wherein said one panel is folded and said pop-up elements are adhesively attached to each other prior to said associating step.

11. A method in accordance with claim 10 wherein said associating step is carried out prior to said severing step which removes an original interconnection between said first basepiece and said pop-up element.

12. A method in accordance wih claim 6 wherein said one panel is originally located in said sheet material between said first and second basepieces and wherein said panel is cut to separate said pop-up elements from each other prior to said associating step.

13. A method in accordance with claim 12 wherein said pop-up elements are each adhesively attached to one of said basepieces prior to said severing step and prior to attachment to each other and wherein said severing step simultaneously severs the original interconnections between both said pop-up elements and said respective basepieces.

14. A method in accordance with claim 2 wherein said pop-up elements are each respectively formed from sheet material adjacent an edge of one of said basepieces and are thus initially hinged thereto.

15. A method in accordance with claim 14 wherein each of said pop-up elements is adhesively attached to one of said basepieces prior to said severing step.

16. A method in accordance with claim 15 wherein said pop-up elements are adhesively attached to each other subsequent to said adhesive attachment to said basepieces and wherein said severing step simultaneously severs said hinged connections between both said pop-up elements and said respective basepieces.

17. A method in accordance with claim 16 wherein said basepieces are substantially rectangular in shape and are initially interconnected along the edge opposite from the edge along which said severing occurs and, in addition to said severing, said opposite edge is trimmed and said basepieces are joined together along a third edge thereof.

18. A method in accordance with claim 14 wherein said sheet material is cut to separate said first basepiece and said interconnected first pop-up element from said second basepiece and said interconnected second pop-up element, and wherein said adhesive attachment of said first pop-up element to said first basepiece is carried out prior to said adhesive attachment of said pop-up element to each other.

19. A method in accordance with claim 18 wherein said first and second basepieces are adhesively joined along their opposite edges from those edges along which said pop-up elements are interconnected to create said common line pivotal relationship and wherein said severing step is therafter effected.

20. An item of the character described which comprises first and second basepieces formed from the same sheet material and joined to each other along a substantially common line, each of which basepieces has an opposite peripheral edge portion that is parallel to said common line, and a pair of pop-up elements adhesively connected to each other and positioned to lie along said opposite peripheral edge of said first basepiece for at least part of the length thereof, with one of said pop-up elements being adhesively attached to said first basepiece at a first hinge element and being interconnected along a fold line to said first basepiece and with said other pop-up element being interconnected along a fold line to said second basepiece and also being adhesively attached to said second basepiece at a second hinge element.

21. A item in accordance with claim 20 wherein said first and second basepieces are adhesively bonded to each other along an edge transverse to said edges.

22. An item of the character described with comprises first and second basepieces and a pair of pop-up elements formed from sheet material, with said pair of pop-up elements being sandwiched between said basepieces and with said basepieces and said pop-up elements all being joined together along a substantially common line, said pop-up elements each having a line of weakness spaced from said common line, said pair of pop-up elements being adhesively connected to each other in the regions located between said respective lines of weakness and said common line, and hinge means extending between and interconnecting a region of each of said pop-up elements on the opposite side of said line of weakness from said common line respectively to each of said basepieces, said hinge means including a pair of hinge elements which are formed either from said pop-up elements or from said basepieces each of which hinge elements is connected to the one of said basepieces or said pop-up elements from which it is formed at a fold line and to the other by an adhesive bond.

23. An item in accordance with claim 22 wherein said lines of weakness are substantially parallel to said common line and said hinge means includes a pair of hinge elements formed from said basepieces which are adhesively bonded to the surface of said pop-up elements that lies adjacent said respective basepiece.

24. An item of the character described which comprises first and second basepieces formed from the same sheet material and joined to each other along a substantially common line, each of which basepieces has an opposite peripheral edge portion that is parallel to said common line, said first and second basepieces having first and second hinge elements respectively formed therein, said first and second hinge elements being positioned equidistantly from said common line, a pair of pop-up elements adhesively connected to each other and positioned to lie along said opposite peripheral edge of said first basepiece for at least part of the length thereof, with one of said pop-up elements being adhesively attached to said first basepiece at a first hinge element and with one of said pop-up elements being interconnected along a fold line either to said first basepiece or to said other pop-up element.

25. An item of the character described which comprises first and second basepieces formed from the same sheet material and joined to each other along a substantially common line, each of which basepieces has an opposite peripheral edge portion that is parallel to said common line, a pair of pop-up elements adhesively connected to each other and positioned to lie along said opposite peripheral edge of said first basepiece for at least part of the length thereof, with one of said pop-up elements being adhesively attached to said first basepiece at a first hinge element and being interconnected along a fold line to said other pop-up element, which fold line lies adjacent to said opposite edge of said first basepiece.

26. An item in accordance with claim 25 wherein said other pop-up element is adhesively attached to said second basepiece at a second hinge element.

27. An item of the character described which comprises first and second basepieces formed from the same sheet material and joined to each other along a substantially common line, each of which basepieces has an opposite peripheral edge portion that is parallel to said common line, a pair of pop-up elements adhesively connected to each other and positioned to lie along said opposite peripheral edge of said first basepiece for at least part of the length thereof, with one of said pop-up elements being interconnected along a fold line to said first basepiece, said other pop-up element being sandwiched between said first basepiece and said one pop-up element and being adhesively attached to said first basepiece at a first hinge element.

* * * * *